US006192836B1

(12) United States Patent
Hung

(10) Patent No.: US 6,192,836 B1
(45) Date of Patent: Feb. 27, 2001

(54) SEPARATE TYPE WATER HEATER

(76) Inventor: Liao Yien Hung, No. 2-4, Lane 867, Sec. 2, Chung Shan Rd., Tai Shan, Taipei (TW)

( * ) Notice: Subject to any disclaimer, the term of this patent is extended or adjusted under 35 U.S.C. 154(b) by 0 days.

(21) Appl. No.: 09/502,461

(22) Filed: Feb. 11, 2000

(51) Int. Cl.[7] ..... F22B 33/00
(52) U.S. Cl. ..... 122/37; 122/14.2
(58) Field of Search ..... 122/14.2, 36, 37, 122/504; 126/251, 369.3

(56) References Cited

U.S. PATENT DOCUMENTS 4,568,821 * 2/1986 Boe ..... 219/419
4,785,792 * 11/1988 Saint Laurent ..... 122/37
5,571,007 * 11/1996 Ishiguro et al. ..... 431/13

* cited by examiner

*Primary Examiner*—Gregory Wilson
(74) *Attorney, Agent, or Firm*—Bacon & Thomas, PLLC

(57) ABSTRACT

A separate type water heater includes two independent first and second housings. The first and second housings respectively have a burning device and a control device that are originally installed together. The components of the devices are connected via piping so that, in use, the first housing provided with the burning device may be installed outdoors, while the second housing with the control device may be installed in a place where the user can easily access, such as the kitchen. Hence, the user can operate the control device indoors to obtain the required hot water. Since the burning device is installed outdoors, possible accidents caused by carbon monoxide can be avoided to ensure the user's safety and properties.

3 Claims, 2 Drawing Sheets

SEPARATE TYPE WATER HEATER

BACKGROUND OF THE INVENTION (a) Field of the Invention

The present invention relates to a separate type water heater, more particularly to a water heater in which a burning device and a control device are separately disposed in separate housings and are connected via piping so that, in use, the control device is disposed indoors whereas the burning device is installed outdoors to permit easy operation and prevent possible accidents due to generation of carbon monoxide.

(b) Description of the Prior Art

A conventional water heater is provided with a housing with piping and cock disposed therein to connect to a gas source. The cock is connected to an ignition unit, which has a burner provided thereon. The burner has a water tank disposed thereon. A coiled pipe is disposed to surround the surface of the water tank. Two ends of the coiled pipe are respectively connected to cold and hot water pipes. The water tank further has a heat exchanger disposed thereon. The heat exchange is provided with a discharge port. The burner is ignited by means of the ignition unit to heat the water in the coiled pipe of the water tank. The waste gas after gas burning is discharged via the discharge port. However, since all the components of the conventional water heat are disposed in the same housing, if the user installed the water heater indoors for facilitation of use during winter times, carbon monoxide generated during gas burning may stay indoors and may cause fatal accidents. If the water heater is installed outdoors, although the problem of carbon monoxide intoxication may be eliminated, use is not convenient. Furthermore, in the conventional water heater, since the waste gas is discharged to the ceiling, it will stain the ceiling, and the discharge is not smooth.

SUMMARY OF THE INVENTION

A primary object of the present invention is to provide a separate type water heater including two independent first and second housings. The first and second housings respectively have a burning device and a control device that are originally installed together. The components of the devices are connected via piping so that, in use, the first housing provided with the burning device may be installed outdoors, while the second housing with the control device may be installed in a place where the user can easily access, such as the kitchen. Hence, the user can operate the control device indoors to obtain the required hot water. Since the burning device is installed outdoors, possible accidents caused by carbon monoxide can be avoided to ensure the user's safety and properties.

Another object of the present invention is to provide a separate type water heater in which a first housing is provided with a discharge hood having two guide ducts extending from both sides thereof such that waste gas generated after gas combustion can flow to the discharge hood for discharge to the outside via the guide ducts, thereby eliminating the problem of direct waste gas discharge to the ceiling as in the prior art, and facilitating discharge of waste gas.

A further object of the present invention is to provide a separate type water heater in which a second housing has both sides respectively provided with more than one set of connecting pipes of stainless steel whereby, in use, the connecting pipes on any one side of the second housing may be connected to the components of a burning device of a first housing as desired by the user.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
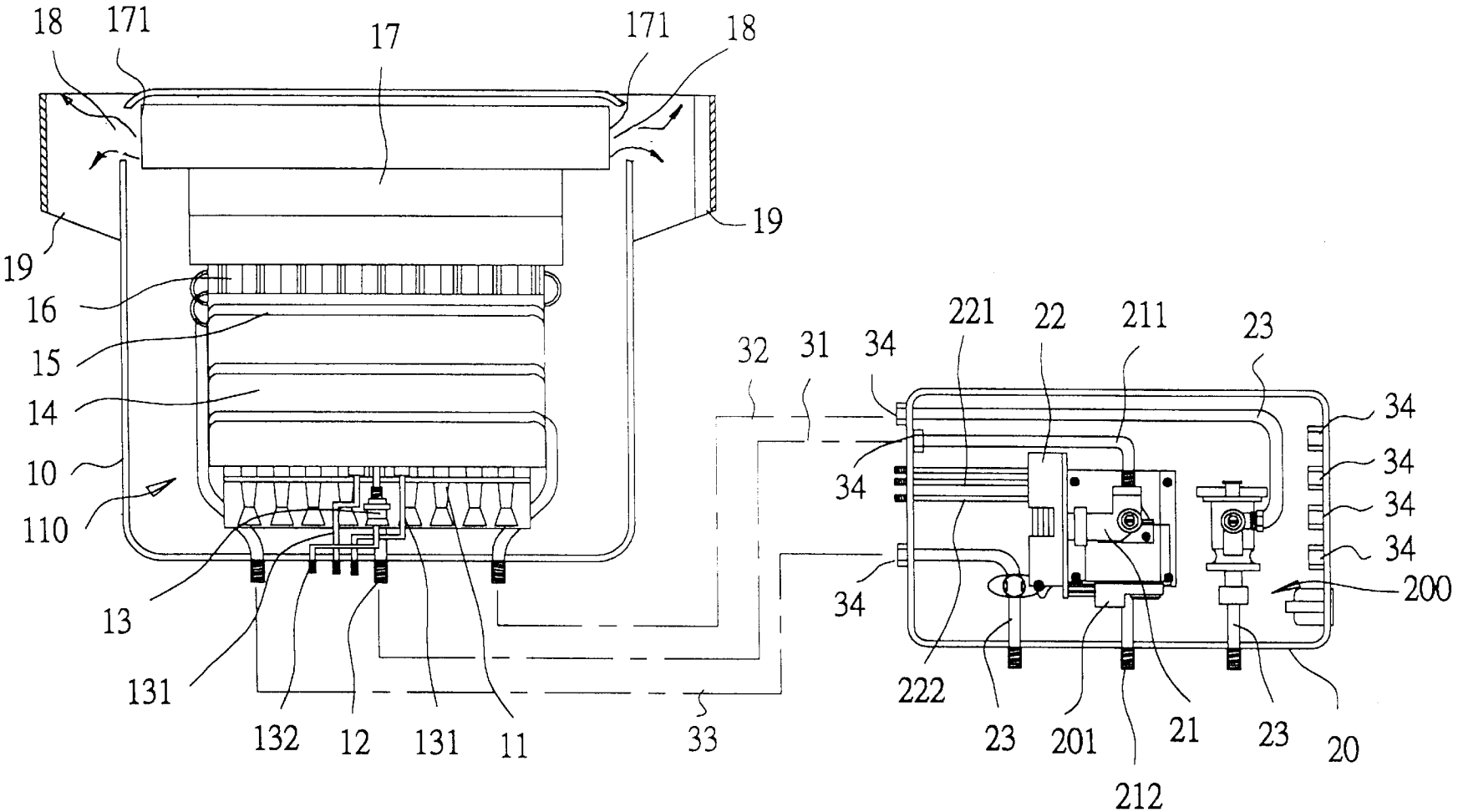
FIG. 1 is a schematic view of the present invention.
Figure 2:
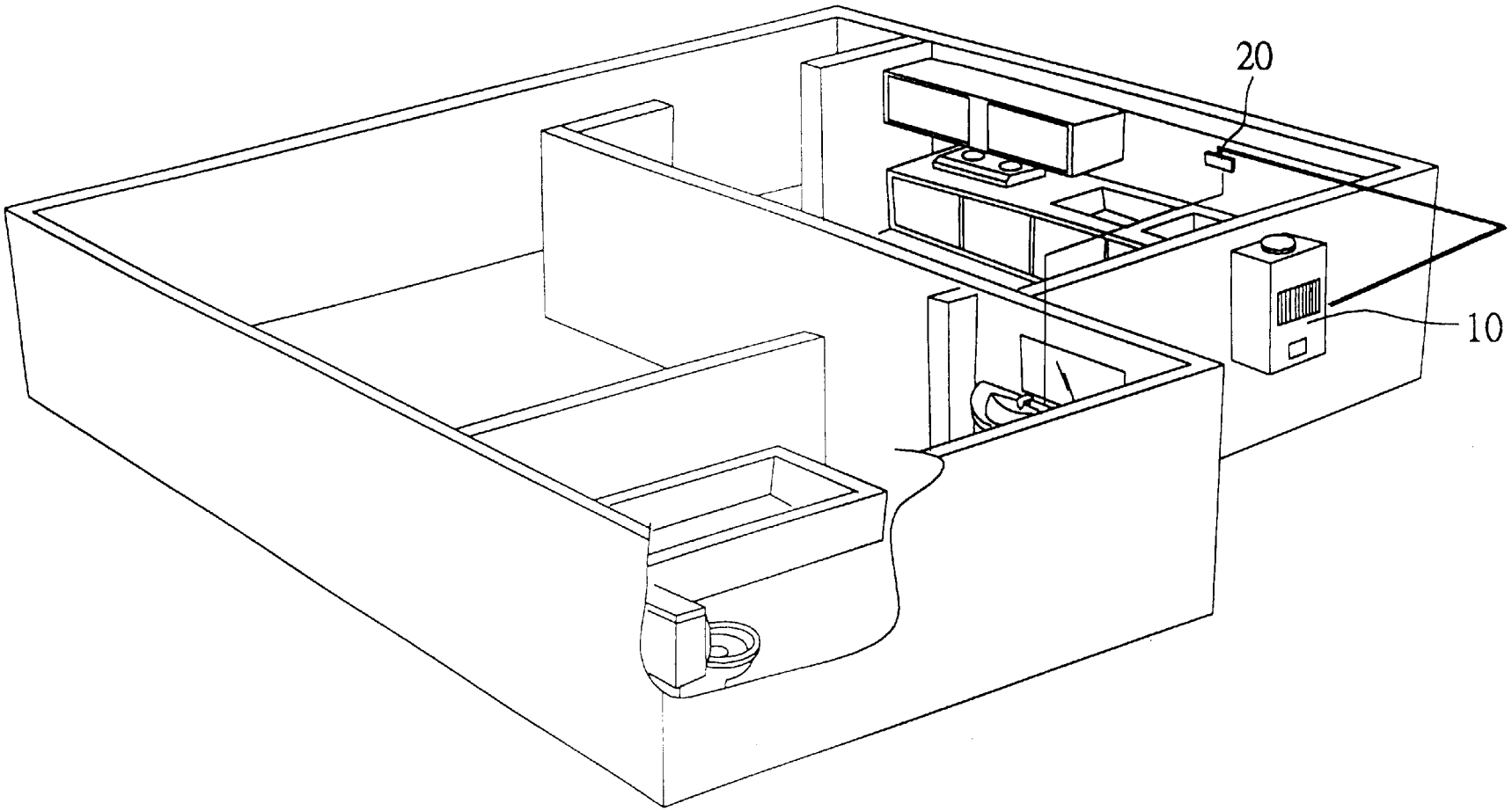
FIG. 2 is a schematic view of the present invention in use.

With reference to FIGS. 1 and 2, a separate type water heater includes two independent first and second housings 10, 20. The first housing 10 includes a burning device 110. The burning device 110 has a burner 11 disposed thereon. The burner 11 is connected to a gas pipe 12. The surface of the burner 11 abuts against an ignition device 13. The ignition device 13 is connected to first and second paths 131, 132. The burner 11 has a water tank 14 provided thereon. The surface of the water tank 14 is surrounded by a coiled pipe 15. The two open ends of the coiled pipe 15 are exposed on the outside of the first housing 10. The water tank 14 has a heat exchanger 16 disposed thereon.

The heat exchange 16 has a discharge hood 17 provided thereon. The discharge hood 17 has guide ducts 171 extending from both sides thereof, respectively. The guide ducts 171 are respectively facing openings 18 in the first housing 10. The openings 18 of the first housing 10 are respectively provided with wind shields 19.

The second housing 20 has a control device 200 disposed thereon. The control device 200 has a cock 21 disposed thereon. The cock 21 is connected to an outlet pipe 211. The outlet pipe 211 may be connected to a stainless steel connecting tube 34 on any one side of the second housing 20. The connecting tube 34 is connected to the gas pipe 12 of the first housing 10 via a gas connecting pipe 31. The cock 21 is additionally connected to an inlet pipe 212. The inlet pipe 212 may be connected to a gas source (not shown). Furthermore, the cock 21 is coupled with a gas switch valve 22. A fire guide pipe 222 is connected to the second path 132 of the first housing via a connecting tube (not shown). The cock 21 further has an electronic sensor 201 connected thereto. The electronic sensor 201 has sensor lines 221 provided thereon. The sensor lines 221 are connected to the first path 131 of the first housing 10 via a connecting pipe (not shown). Furthermore, the second housing 20 has guide ducts 23 provided thereon. The guide ducts 23 have two ends respectively connected to cold and hot water sources (not shown) and the connecting pipe 34 on any one side of the second housing 20. The connecting pipes 34 are connected to the two ends of the coiled pipe 15 of the first housing 10 via cold and hot pipes 32, 33.

In use, with reference to FIGS. 1 and 2, the first housing 10 is fixedly disposed outdoors, and the second housing 20 is installed indoors (for example, in the kitchen). In this way, the user can operate the control device 200 of the second housing 20 to obtain hot water. And since the first housing 10 accommodating the burning device 110 is disposed outdoors, possible accidents due to the generation of carbon monoxide can be prevented. The user's safety and properties can therefore be ensured. The drawbacks of the prior art can therefore be obviated. Besides, the waste gas generated after gas combustion can be guided to the discharge hood 17 to be discharged via the guide ducts 171 on both sides of the discharge hood 17 to the outside. As compared with the prior art which conducts the waste gas upwardly to the ceiling, the present invention allows smoother discharge of waste gas. Furthermore, the wind shields 19 at the openings 18 can block rain and wind to ensure smooth burning of the gas, unlike the prior art in which the wind can blow into the housing.

Although the present invention has been illustrated and described with reference to the preferred embodiment thereof, it should be understood that it is in no way limited to the details of such embodiment but is capable of numerous modifications within the scope of the appended claims.

What is claimed is:

1. A separate type water heater, comprising independent first and second housings, said first and second housings respectively having a burning device and a control device that are originally installed together, components of said devices being connected via piping so that, in use, said first housing provided with said burning device may be installed outdoors, while said second housing with said control device may be installed in a place where the user can easily access, whereby the user can operate said control device indoors to obtain the required hot water, and since said burning device is installed outdoors, possible accidents caused by carbon monoxide can be avoided to ensure the user's safety and properties.

2. The separate type water heater as defined in claim 1, wherein said first housing is provided with a discharge hood, said discharge hood having two guide ducts extending from both sides thereof such that waste gas generated after gas combustion can flow to said discharge hood for discharge to the outside via said guide ducts, thereby eliminating the problem of direct waste gas discharge to the ceiling as in the prior art, and facilitating discharge of waste gas.

3. The separate type water heater as defined in claim 1, wherein said second housing has both sides respectively provided with more than one set of connecting pipes of stainless steel whereby, in use, said connecting pipes on any one side of said second housing may be connected to the components of said burning device of said first housing as desired by the user.

* * * * *